US007629524B2

(12) United States Patent
Lin

(10) Patent No.: US 7,629,524 B2
(45) Date of Patent: Dec. 8, 2009

(54) CHIME BAR ASSEMBLY

(76) Inventor: Yi-Sheng Lin, P.O. Box 44-2049, Taipei (TW) 10668

( * ) Notice: Subject to any disclaimer, the term of this patent is extended or adjusted under 35 U.S.C. 154(b) by 47 days.

(21) Appl. No.: 12/068,140

(22) Filed: Feb. 4, 2008

(65) Prior Publication Data

US 2009/0193957 A1 Aug. 6, 2009

(51) Int. Cl.
*G10D 13/02* (2006.01)

(52) U.S. Cl. ..... 84/402; 84/404

(58) Field of Classification Search ..... 84/402, 84/404

See application file for complete search history.

(56) References Cited

U.S. PATENT DOCUMENTS 4,599,932 A * 7/1986 Malta ..... 84/404
5,207,769 A * 5/1993 Malta ..... 84/804
5,986,194 A * 11/1999 Schwartz et al. ..... 84/404
6,005,177 A * 12/1999 Malta ..... 84/404

* cited by examiner

*Primary Examiner*—Jianchun Qin

(57) ABSTRACT

A chime bar assembly includes a hollow body with a resonation space defined therein and a top opening is defined in a top of the hollow body. A metal plate is located above the top opening and supported by two rubber plates. A hitting device is connected to the rear end of the hollow body and includes a case which includes lugs to which a pivotal end of a rod is pivotably connected. An operation unit is connected to the case and pushes the pivotal end of the rod so that the sphere is lowered to hit the metal plate.

3 Claims, 15 Drawing Sheets

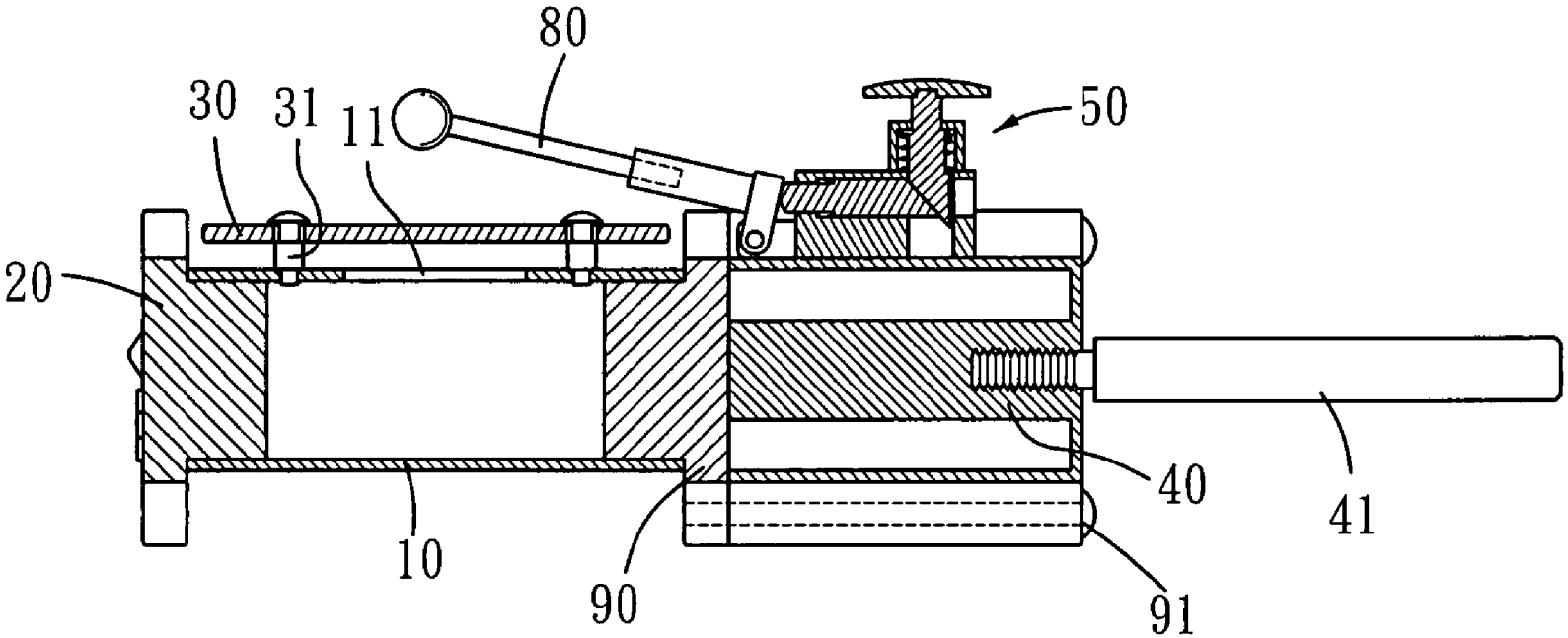
FGI. 16

CHIME BAR ASSEMBLY

BACKGROUND OF THE INVENTION (1) Field of the Invention

The present invention relates to a percussion device, especially to a chime bar assembly with a hitting device connected with the hollow body.

(2) Background of the Invention

A conventional chime bar assembly generally includes a hollow body with two open ends which are sealed by a front cover and a rear cover so as to form a resonation space in the hollow body. The hollow body includes a top opening and a metal plate is located above the top opening so that the user hits the metal plate by a stick and the sound is resonated within the hollow body to generate a specific sound. However, the users spend a lot of time to find the stick because the stick is an individual part from the hollow body and often put randomly. Besides, the operation is boring by holding the stick to hit the metal plate.

The present invention intends to provide a chime bar assembly with a hitting device connected to the hollow body, the hitting device can be operated by different ways to hit the metal plate to generate the sound.

SUMMARY OF THE INVENTION

The present invention relates to a chime bar assembly and comprises a hollow body including a resonation space defined therein, the hollow body including a front opening, a rear opening and a top opening. A front cover seals the front opening of the hollow body and a rear box seals the rear opening of the hollow body. A metal plate is located above the top opening and supported by two rubber plates. A hitting device is connected to the rear box and includes a case which includes lugs. A rod has a sphere on a first end thereof and a pivotal end on a second end of the rod, the pivotal end is pivotably connected to the lugs. An operation unit is connected to the case and pushes the pivotal end of the rod so that the sphere is lowered to hit the metal plate.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 16 is a cross sectional view of the fifth embodiment of the chime bar assembly of the present invention.

DETAILED DESCRIPTION OF THE PREFERRED EMBODIMENTS

Figure 1:
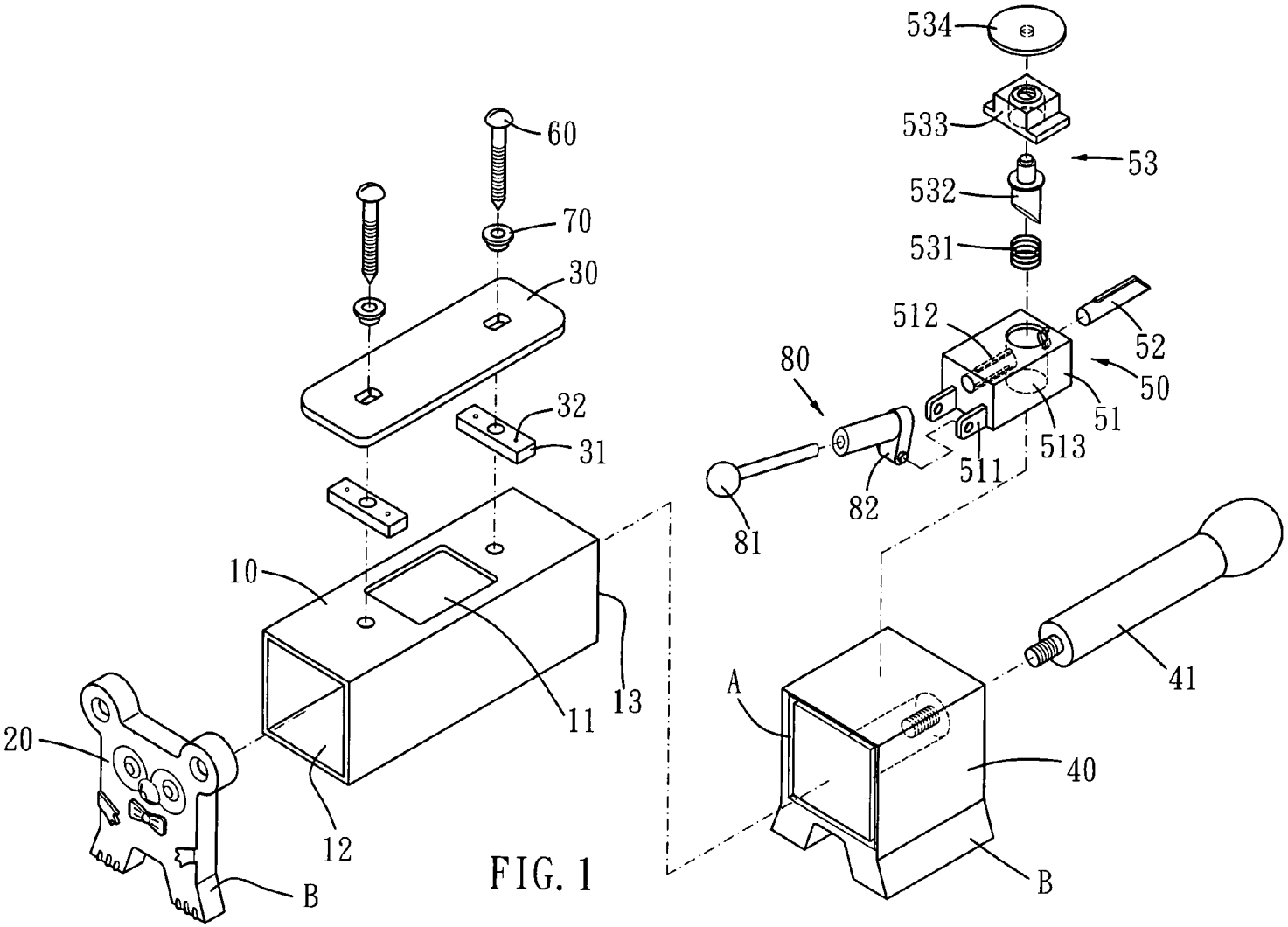
FIG. 1 is an exploded view to show the chime bar assembly of the present invention.
Figure 2:
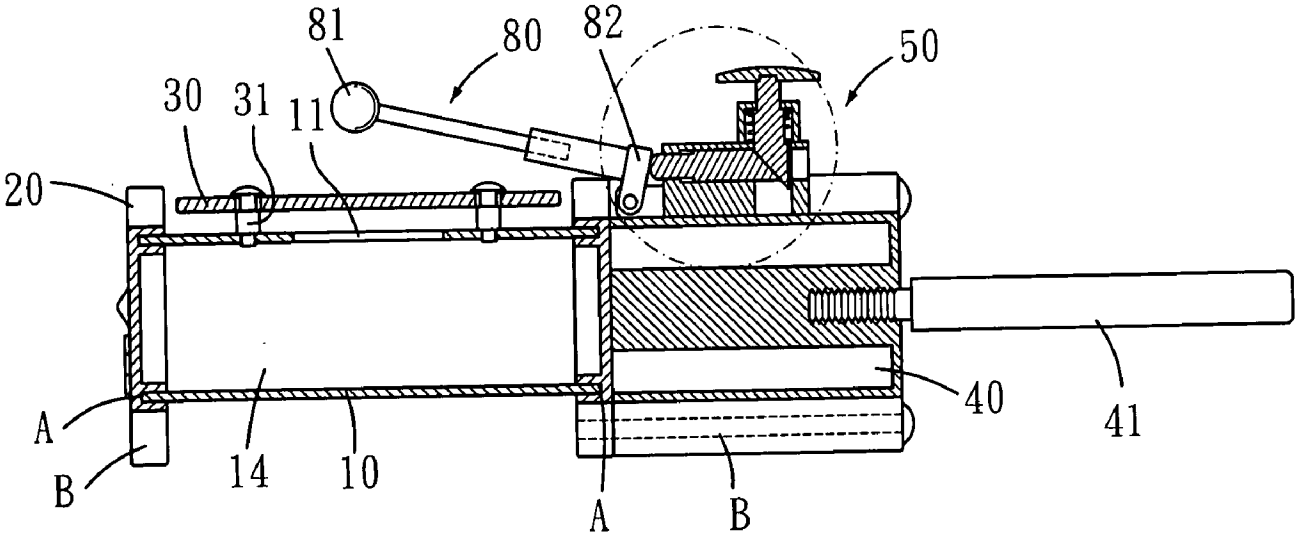
FIG. 2 is a cross sectional view of the chime bar assembly of the present invention.
Figure 2A:
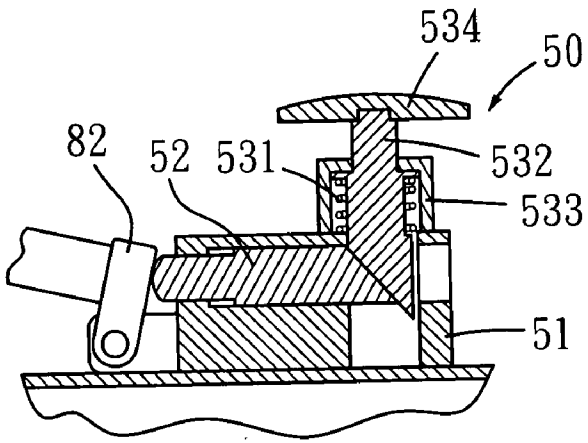
FIG. 2A is an enlarged cross sectional view of the circled part in FIG. 2.

Referring to FIGS. 1, 2 and 2A, the chime bar assembly of the present invention comprises a hollow body 10 including a resonation space 14 defined therein, the hollow body 10 including a front opening 12, a rear opening 13 and a top opening 11. A front cover 20 has an engaging portion "A" which is engaged with the front opening 12 of the hollow body and the front cover 20 seals the front opening 12 of the hollow body 10. The front cover 20 further includes a leg portion "B" for standing on a table top. A rear box 40 has another engaging portion "A" which is engaged with the rear opening 13 of the hollow body 10 and the rear box 40 seals the rear opening 13 of the hollow body 10. The rear box 40 further includes another leg portion "B" for standing on a table top. A handle 41 is connected to the rear box 40.

A metal plate 30 is located above the top opening 11 and two rubber plates 31 are connected between the hollow body 10 and the metal plate 30. Each of the two rubber plates 31 has bosses 32 on which the metal plate 30 are supported. Two screws 60 extend through two washers 70, two holes in the metal plate 30, two holes in the two rubber plates 31 and are connected to the hollow body 10.

A hitting device 50 is connected to the rear box 40 and includes a case 51 which includes two lugs 511 on a front end thereof. A rod 80 has a sphere 81 on a first end thereof and a pivotal end 82 on a second end of the rod 80, the pivotal end 82 is pivotably connected to the lugs 511.

An operation unit 53 is connected to the case 51 and includes a first passage 512 defined axially through front and rear ends thereof and a second passage 513 is defined through a top of the case 51. The second passage 513 is perpendicular to the first passage 512. A push rod 52 is located in the first passage 512 and a first end of the push rod 52 extends out from the front end of the case 51, the first end of the push rod 52 is in contact with the pivotal end 82 of the rod 80. A first inclined surface is defined in a second end of the push rod 52. An operation rod 532 includes a second inclined surface defined in a lower end thereof, the first and second inclined surfaces are slidably engaged with each other. A top end of the operation rod 532 extends from the top of the case 51 and extends through a top cover 533. A spring 531 is received in the top cover 533 and mounted on the operation rod 532. A button 534 is connected to the top end of the operation rod 532.

Figure 3:
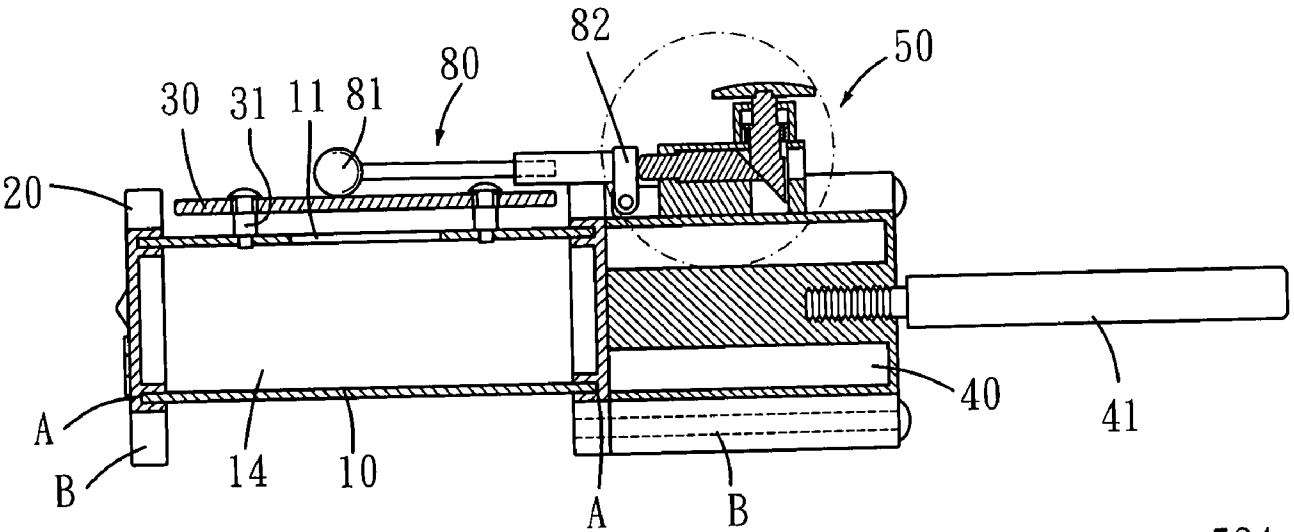
FIG. 3 is a cross sectional view of the chime bar assembly of the present invention wherein the rod is pivoted to hit the metal plate.
Figure 3A:
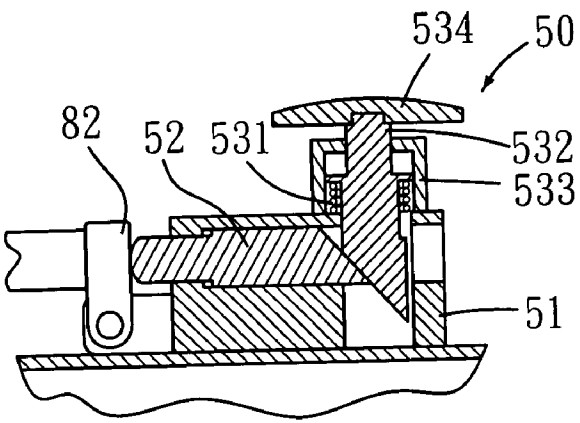
FIG. 3A is an enlarged cross sectional view of the circled part in FIG. 3.

As shown in FIGS. 3 and 3A, when pushing the button 534, the operation rod 532 is lowered to push the push rod 52 which pivots the pivotal end 82 so that the sphere 81 of the rod 80 is lowered to hit the metal plate 30.

Figure 4:
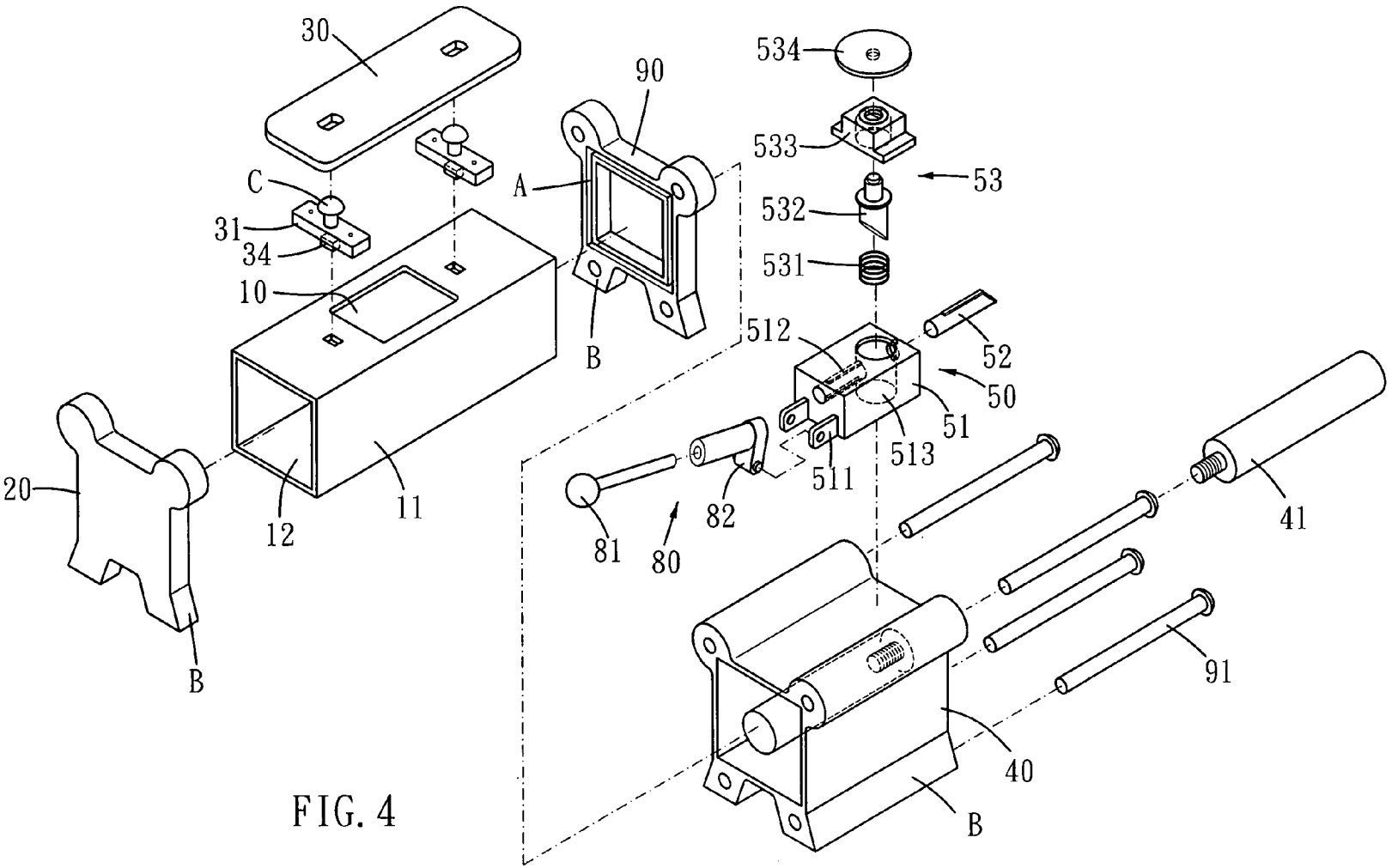
FIG. 4 is an exploded view to show the second embodiment of the chime bar assembly of the present invention.
Figure 5:
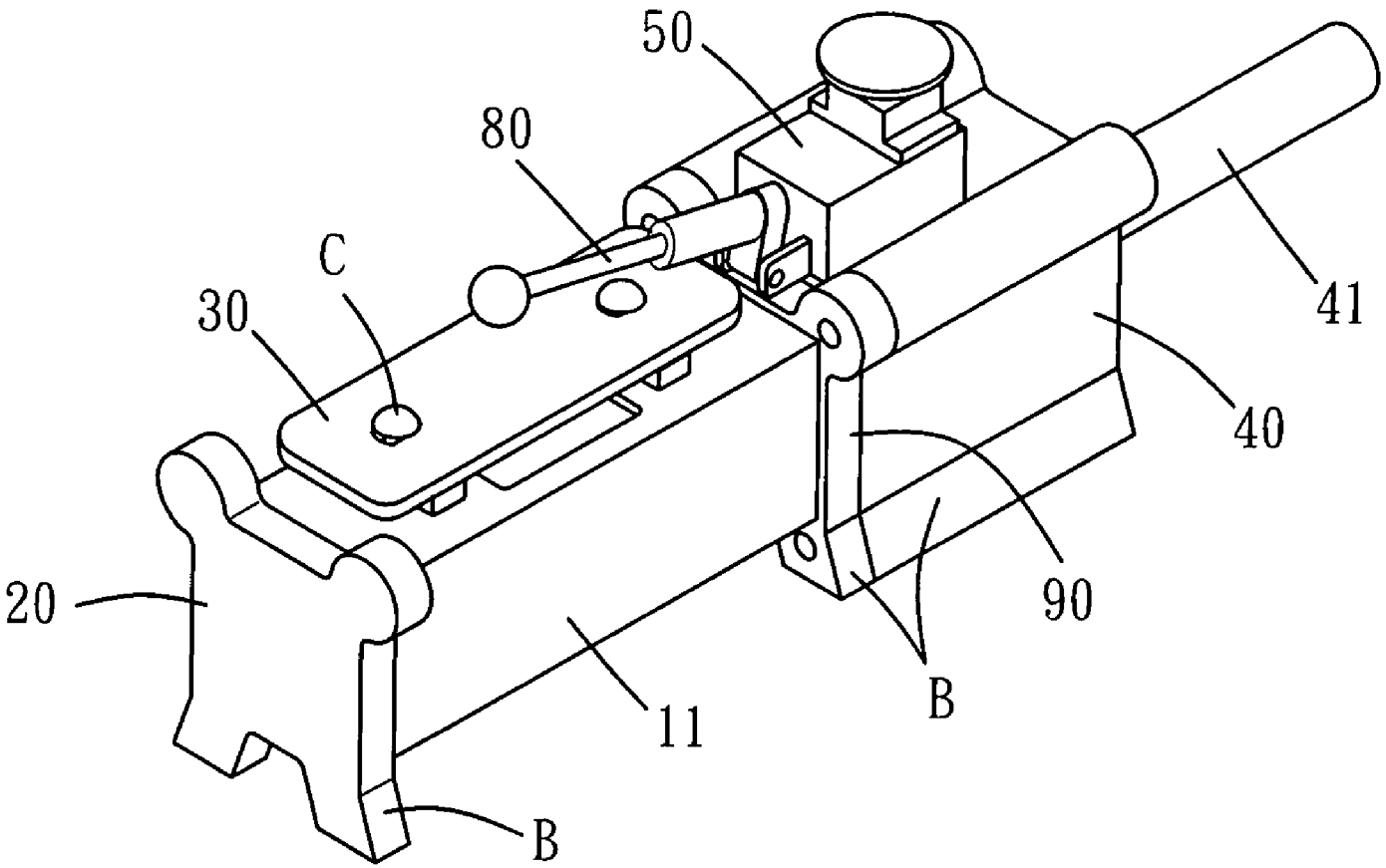
FIG. 5 is a perspective view to show the second embodiment of the chime bar assembly of the present invention.
Figure 6:
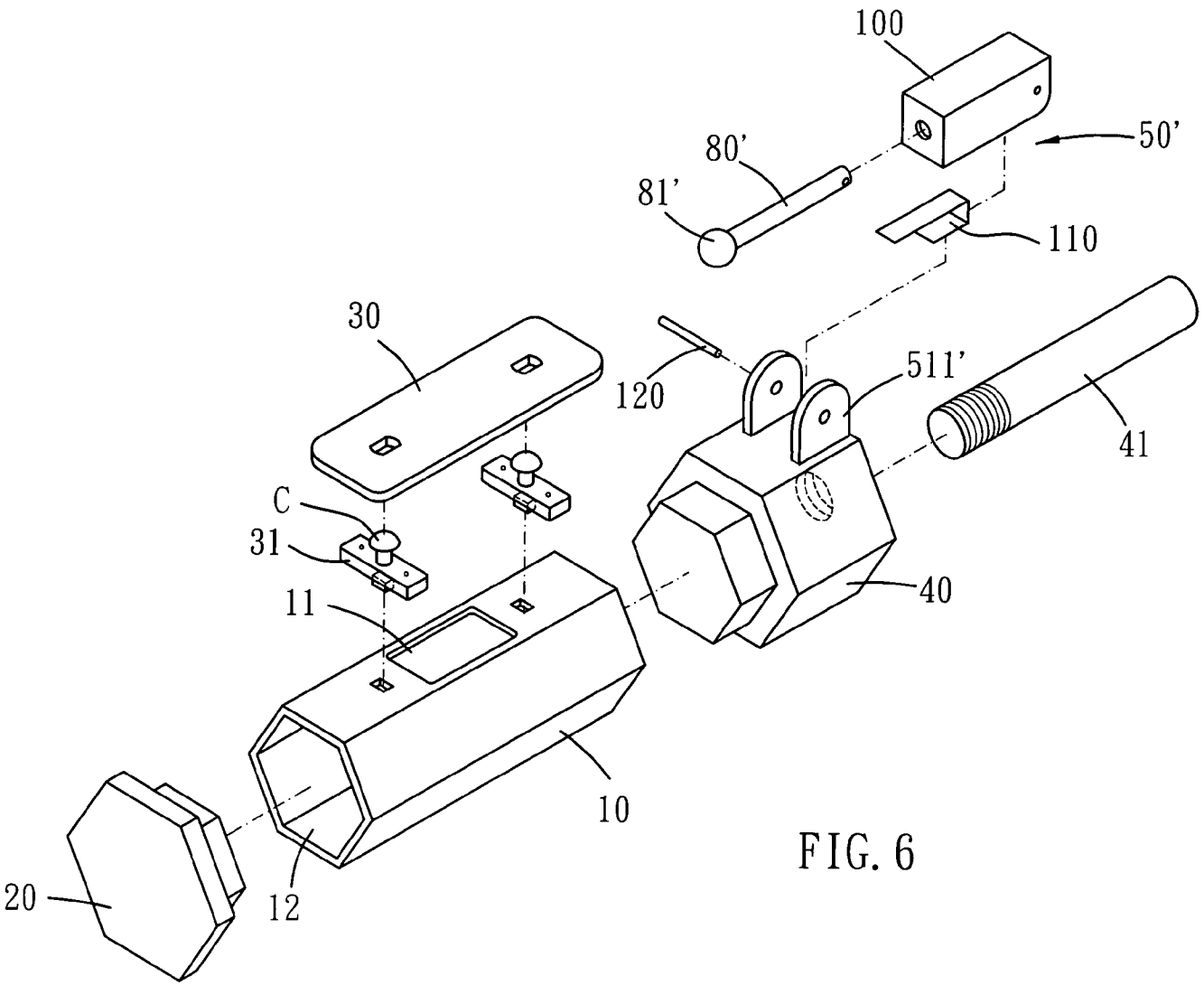
FIG. 6 is an exploded view to show the third embodiment of the chime bar assembly of the present invention.
Figure 7:
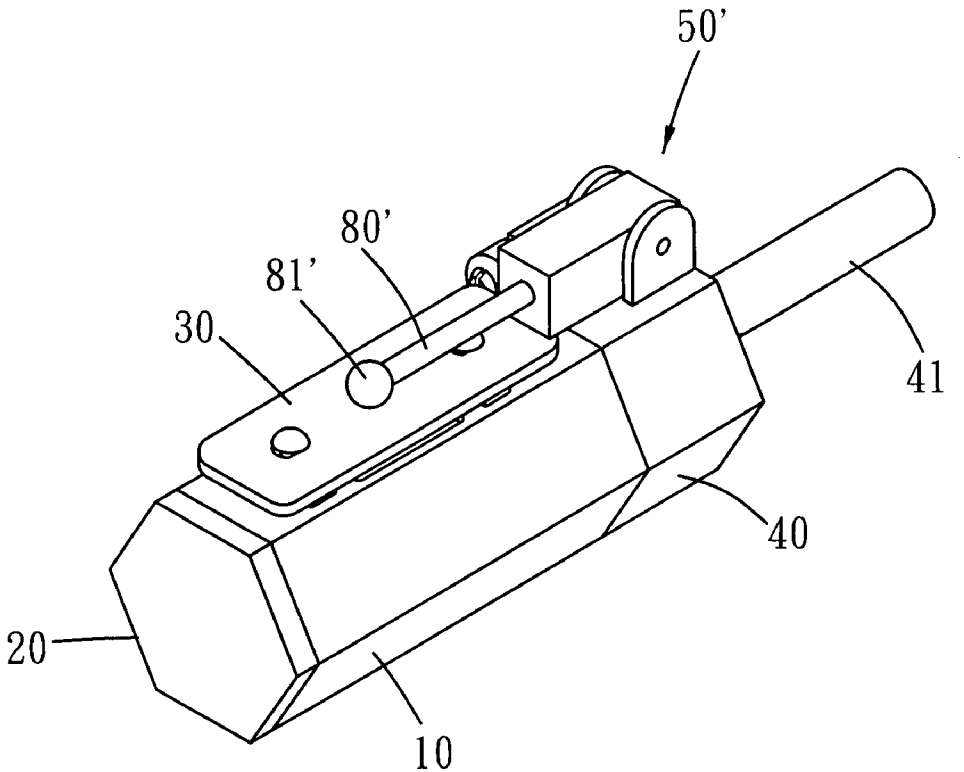
FIG. 7 is a perspective view to show the third embodiment of the chime bar assembly of the present invention.
Figure 8:
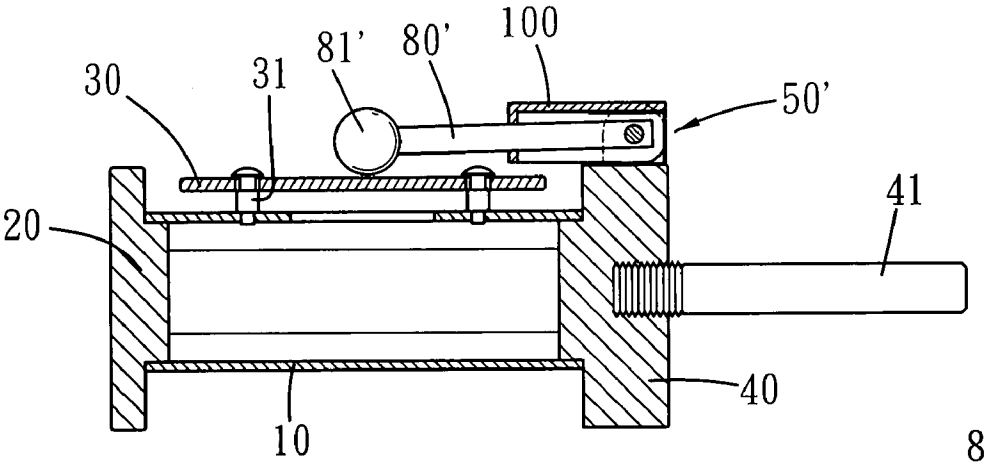
FIG. 8 is a cross sectional view of the third embodiment of the chime bar assembly of the present invention, wherein the rod is pivoted downward to hit the metal plate.
Figure 9:
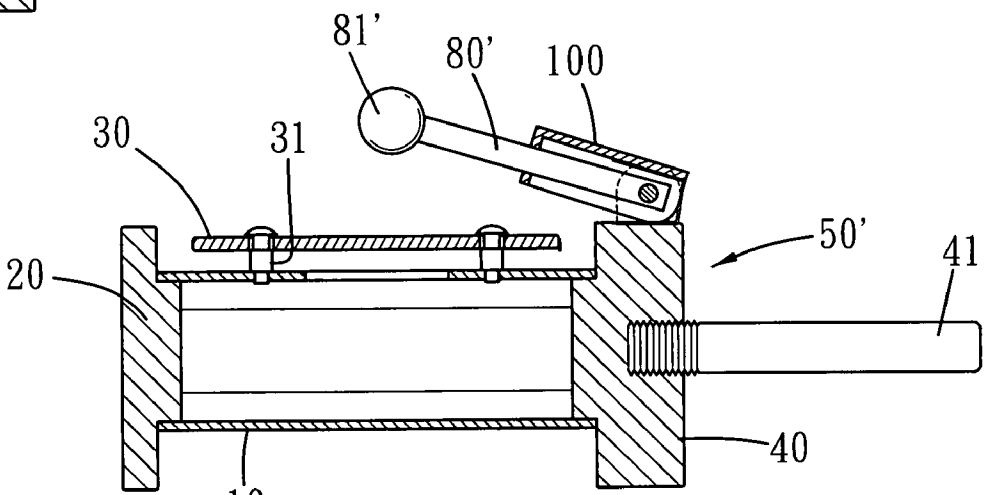
FIG. 9 is a cross sectional view of the third embodiment of the chime bar assembly of the present invention, wherein the rod is pivoted upward and does not hit the metal plate.
Figure 10:
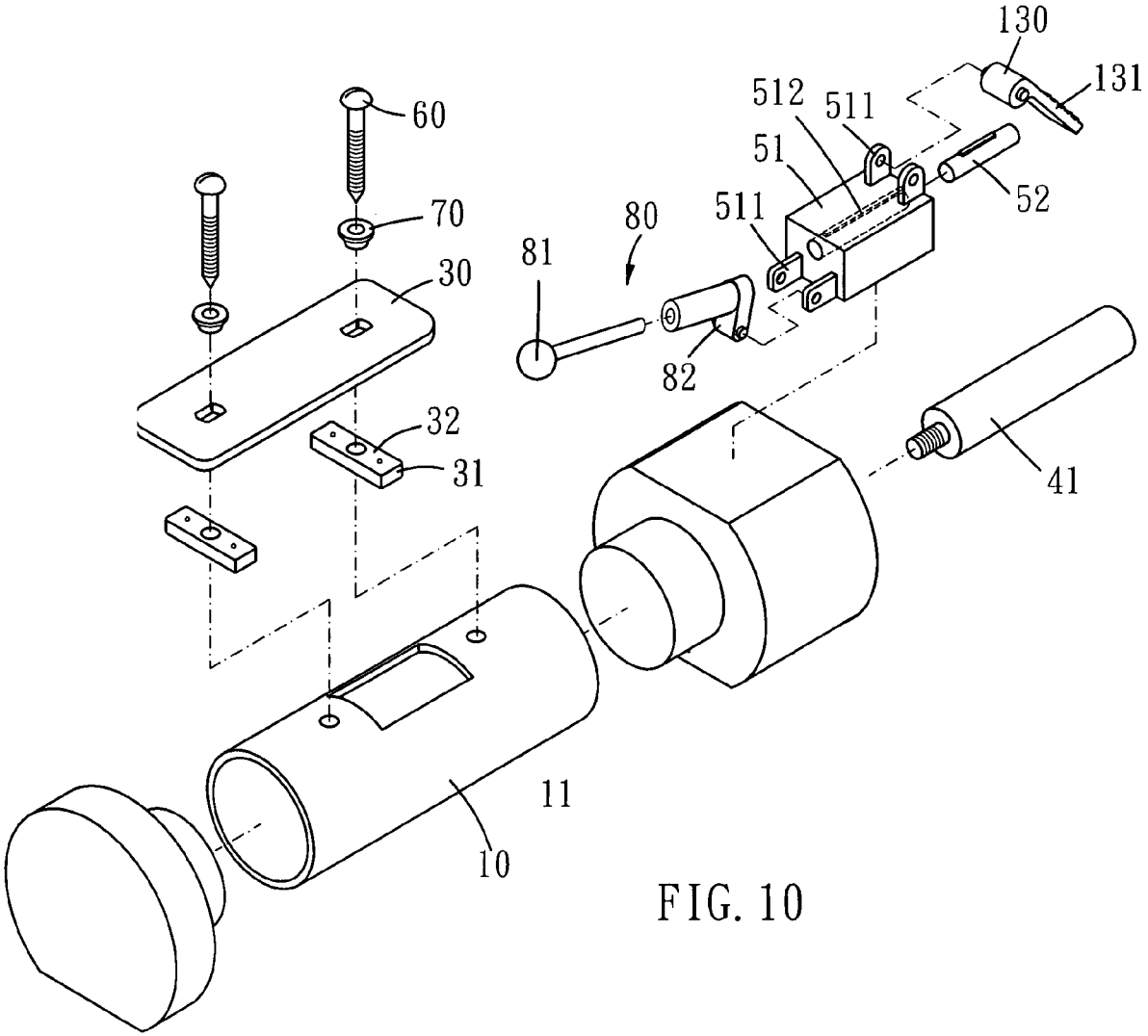
FIG. 10 is an exploded view to show the fourth embodiment of the chime bar assembly of the present invention.
Figure 11:
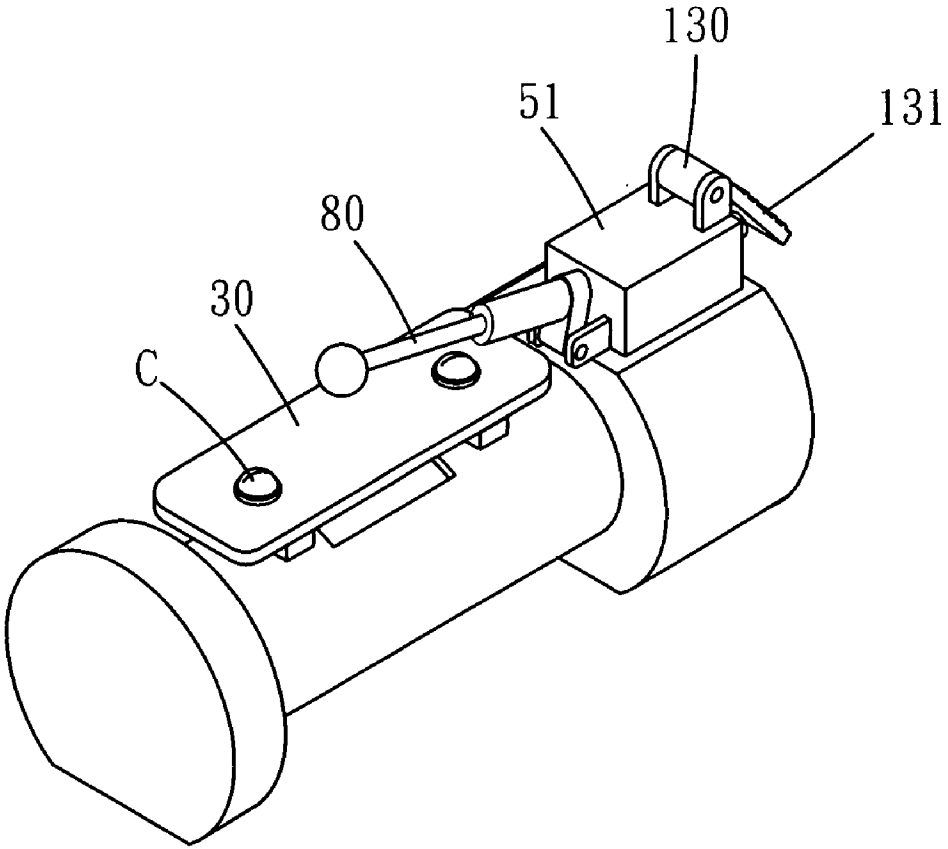
FIG. 11 is a perspective view to show the fourth embodiment of the chime bar assembly of the present invention.
Figure 12:
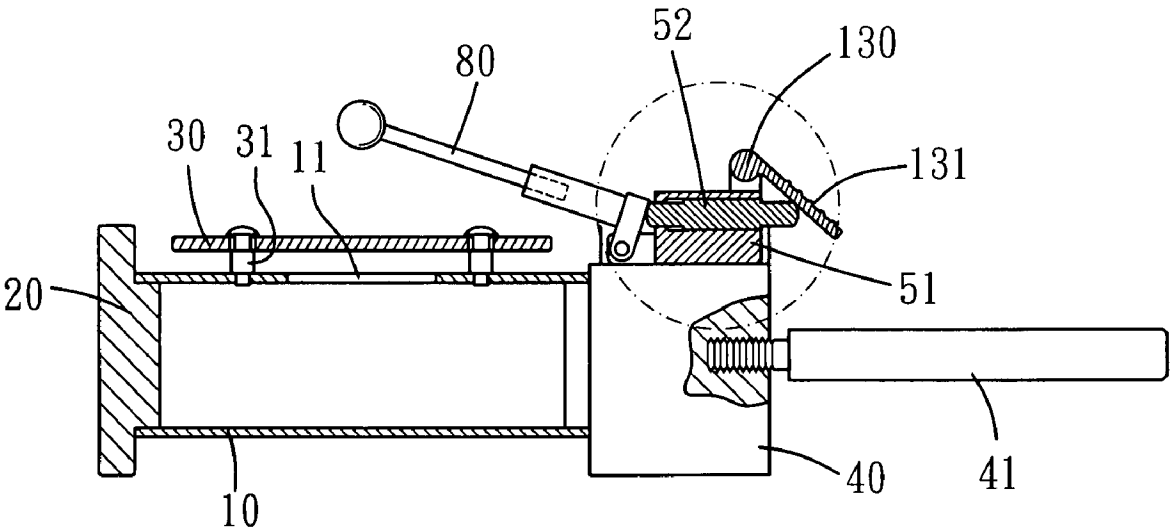
FIG. 12 is a cross sectional view of the fourth embodiment of the chime bar assembly of the present invention wherein the rod does not yet hit the metal plate.
Figure 12A:
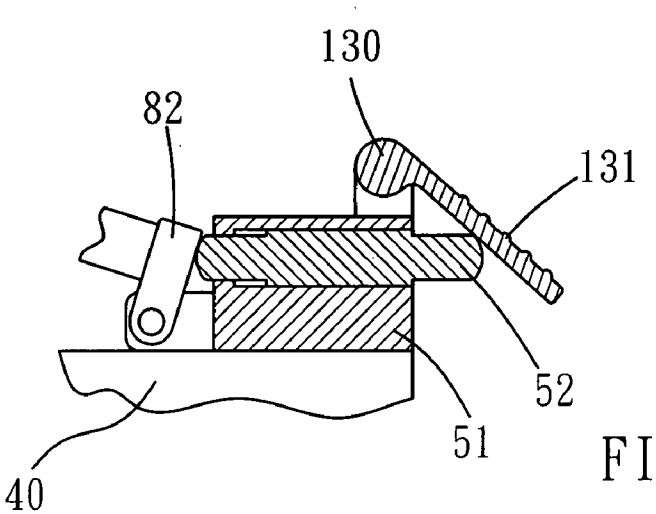
FIG. 12A is an enlarged cross sectional view of the circled part in FIG. 12.

FIGS. 4 and 5 show the second embodiment of the chime bar assembly of the present invention, wherein the two rubber plates 31 each have a protrusion 34 on its bottom so as to be engaged with holes in the hollow body 10. Each rubber plate 31 further includes a connection part "C" so that the metal plate 30 is securely engaged with the connection parts "C". The rear box 40 is cooperated with a rear cover 90 which has the engaging portion "A" and the leg portion "B". The rear box 40 is connected to the rear cover 90 and the hollow body 10 by four pins 91 as shown.

FIGS. 6 to 9 show the third embodiment of the chime bar assembly of the present invention, wherein the hollow body 10, the front cover 20 and the rear box 40 have a polygonal outside. The two lugs 511' extend from a top of the rear box 40 and the case 100 is pivotably, connected to the lugs 511' by a pin 120. The hitting device 50' has a flexible member 110 received in the case 100 thereof and the rod 80' has an end inserted into the case 100 and is connected with the flexible member 110. The user holds the handle 41 and shakes up and down to let the rod 80' pivoted about the pin 120 such that the sphere 81' of the rod 80' can hit the metal plate 30.

Figure 13:
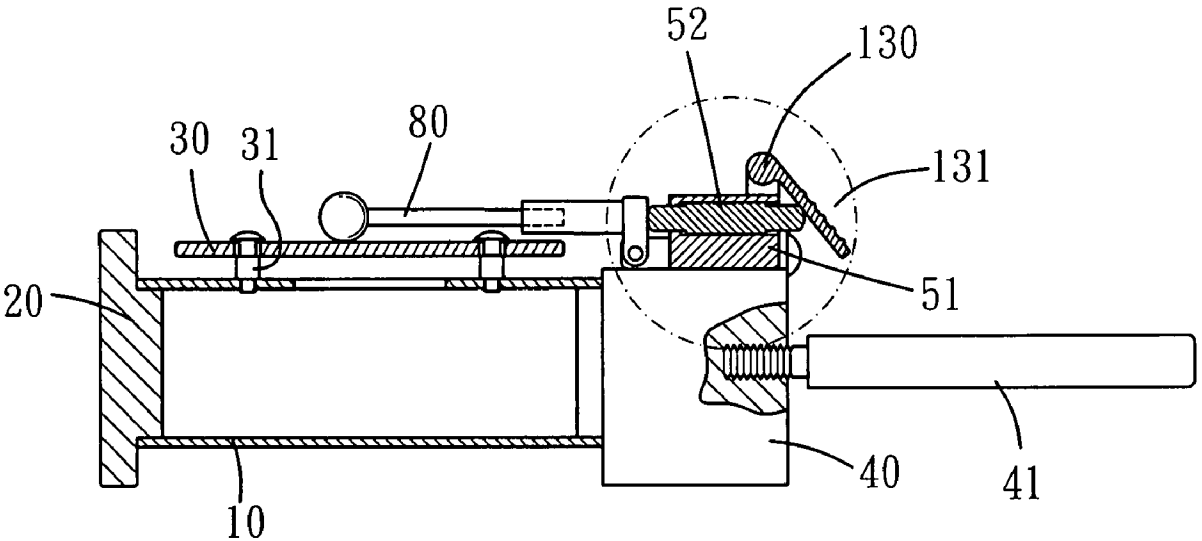
FIG. 13 is a cross sectional view of the fourth embodiment of the chime bar assembly of the present invention wherein the rod is lowered to hit the metal plate.
Figure 13A:
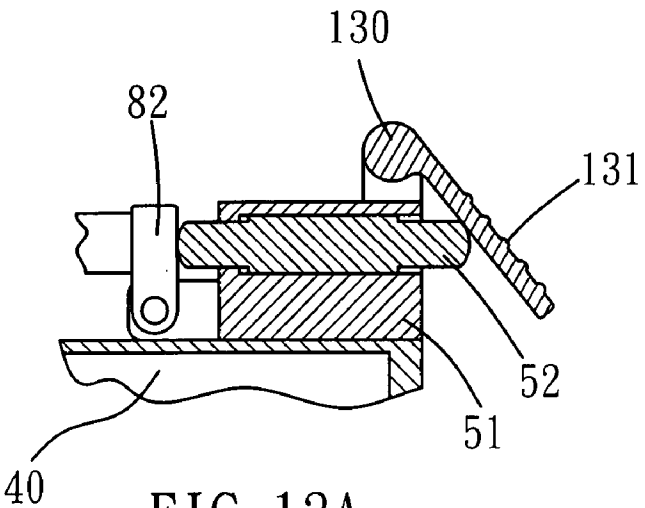
FIG. 13A is an enlarged cross sectional view of the circled part in FIG. 13.

FIGS. 10, 11, 12 and 12A show a fourth embodiment of the chime bar assembly wherein the push rod 52 is longer than that in the first embodiment and does not have the first inclined surface, the second end of the push rod 52 extends out from the rear end of the case 51. An operation plate 130 is pivotably connected to the lugs 511 on a top of the case 51 and includes an operation surface 131 which can be pushed to push the second end of the push rod 52 so as to pivot the pivotal end 82 of the rod 80 as shown in FIGS. 13, 13A.

Figure 14:
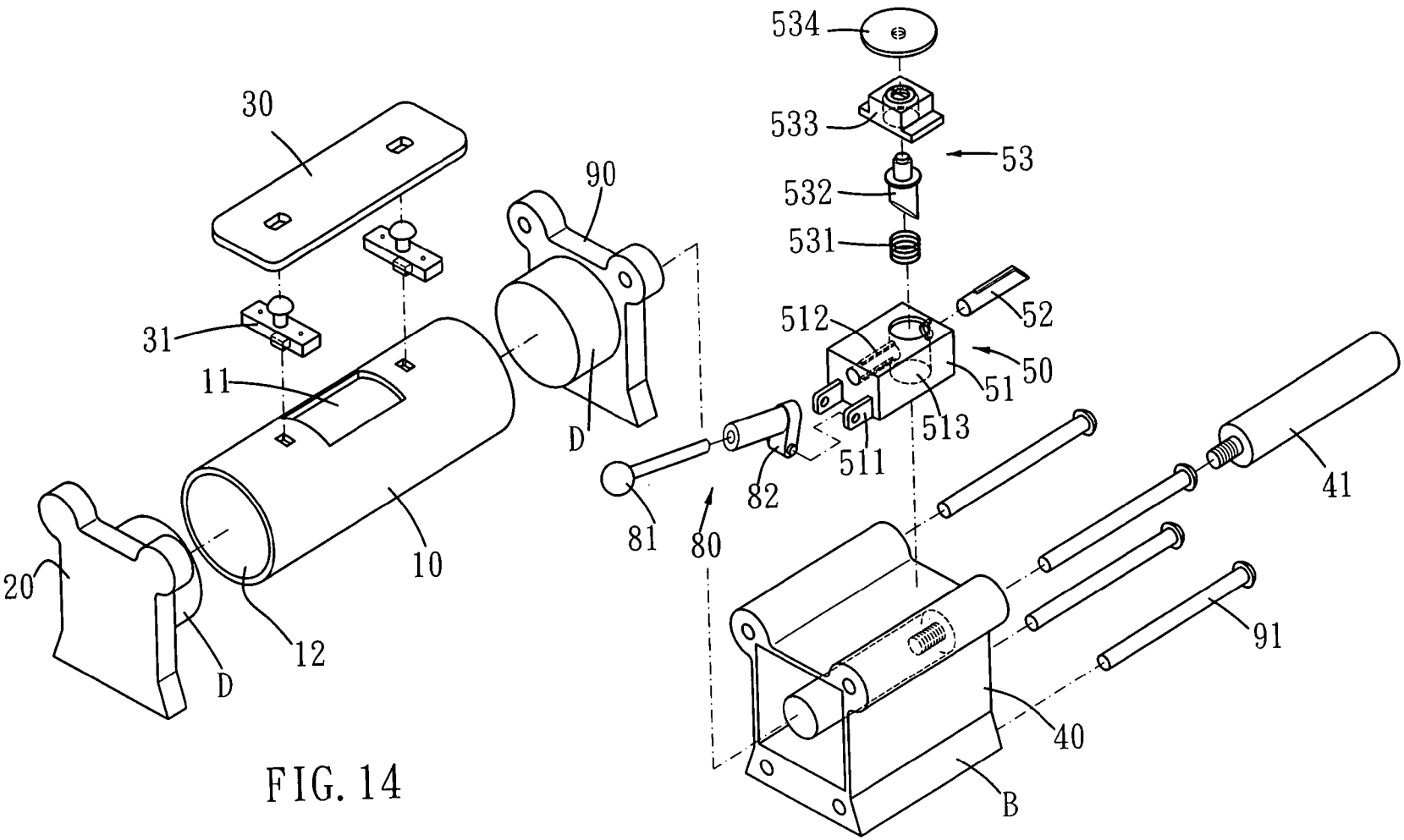
FIG. 14 is an exploded view to show the fifth embodiment of the chime bar assembly of the present invention.
Figure 15:
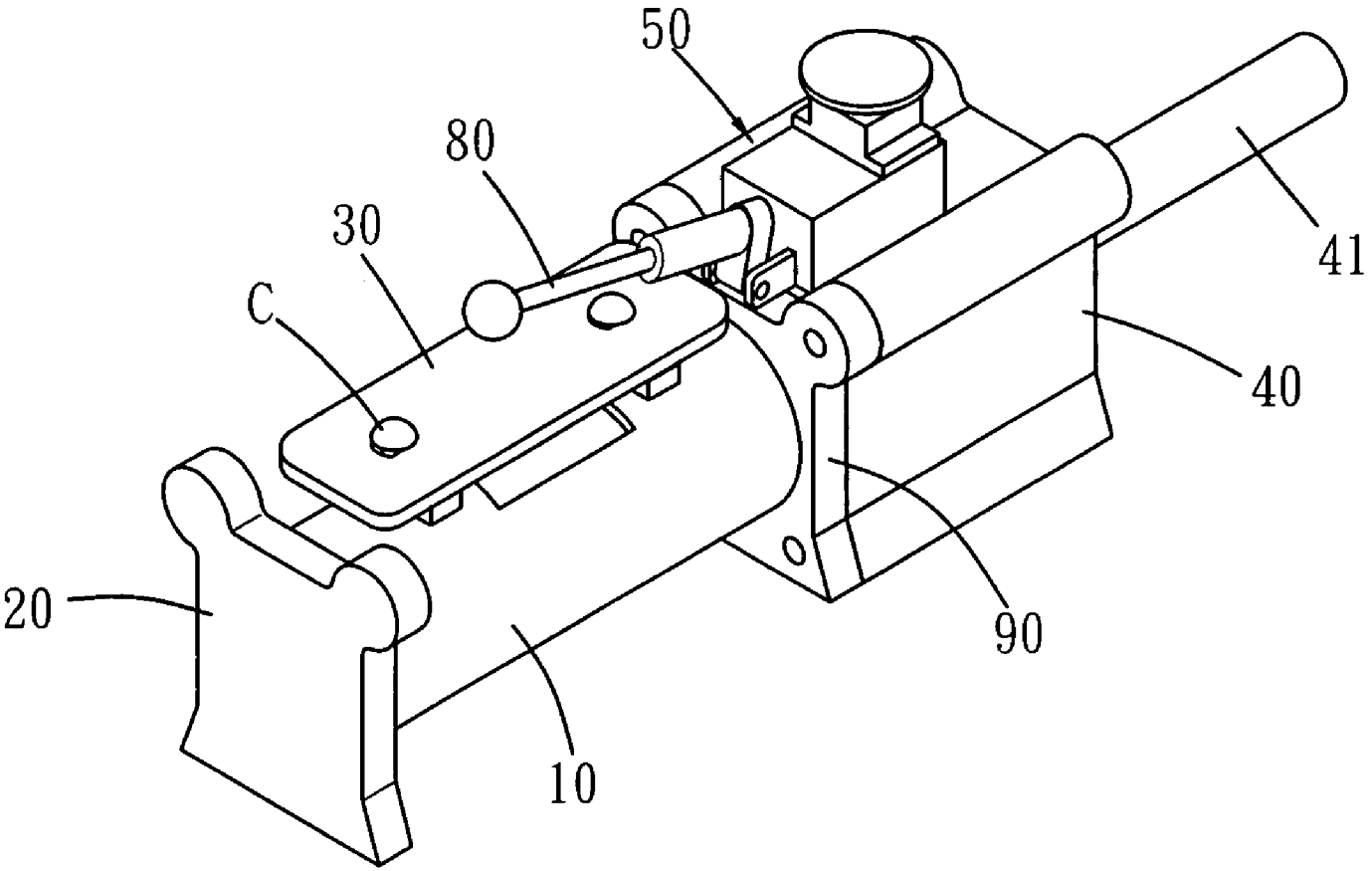
FIG. 15 is a perspective view to show the fifth embodiment of the chime bar assembly of the present invention.

FIGS. 14 to 16 show a fourth embodiment of the chime bar assembly wherein the hollow body 10 is a tubular body with a circular cross sectional section, and each of the front cover 20 and the rear cover 90 includes a tubular portion "D" which is inserted into the hollow body 10.

While we have shown and described the embodiment in accordance with the present invention, it should be clear to those skilled in the art that further embodiments may be made without departing from the scope of the present invention.

What is claimed is:

1. A chime bar assembly comprising:

a hollow body including a resonation space defined therein, the hollow body including a front opening, a rear opening and a top opening;

a front cover having an engaging portion which is engaged with the front opening of the hollow body and the front cover sealing the front opening of the hollow body;

a rear box having another engaging portion which is engaged with the rear opening of the hollow body and the rear box sealing the rear opening of the hollow body;

a metal plate located above the top opening and two rubber plates connected between the hollow body and the metal plate, each of the two rubber plates having bosses on which the metal plate are supported, and a hitting device connected to the rear box and including a case which includes lugs, a rod having a sphere on a first end thereof and a pivotal end on a second end of the rod, the pivotal end pivotably connected to the lugs, an operation unit connected to the case and pushing the pivotal end of the rod so that the sphere is lowered to hit the metal plate.

2. The assembly as claimed in claim 1, wherein the rear box has a handle connected thereto.

3. The assembly as claimed in claim 1, wherein the case includes a first passage defined axially through front and rear ends thereof and a second passage is defined through a top of the case and perpendicular to the first passage, a push rod located in the first passage and a first end of the push rod extends out from the front end of the case, the first end of the push rod is in contact with the pivotal end of the rod, a first inclined surface is defined in a second end of the push rod, the operation unit includes an operation rod which includes a second inclined surface defined in a lower end thereof, the first and second inclined surfaces are slidably engaged with each other, a top end of the operation rod extends from the top of the case and extends through a top cover, a spring is received in the top cover and mounted on the operation rod, a button is connected to the top end of the operation rod.

* * * * *